United States Patent [19]

Fritz

[11] 4,189,885

[45] Feb. 26, 1980

[54] CHANNEL MEMBER FOR SIDING CONSTRUCTION

[75] Inventor: Jack E. Fritz, Walled Lake, Mich.

[73] Assignee: Wolverine Aluminum Corporation, Lincoln Park, Mich.

[21] Appl. No.: 937,878

[22] Filed: Aug. 29, 1978

[51] Int. Cl.[2] ..... E04F 13/06

[52] U.S. Cl. ..... 52/287; 52/282; 52/288; 52/278; 52/716

[58] Field of Search ..... 52/272, 282, 287, 288, 52/716, 278

[56] References Cited

U.S. PATENT DOCUMENTS

| | | | |
|---|---|---|---|
| 1,521,938 | 1/1925 | Gartenberg | 52/282 |
| 2,496,910 | 2/1950 | Fridolph | 52/716 |
| 3,456,409 | 7/1969 | Piget | 52/282 |
| 3,603,054 | 9/1971 | Didry | 52/282 |
| 3,855,746 | 12/1974 | Leggiere | 52/288 |

*Primary Examiner*—James L. Ridgill

[57] ABSTRACT

Trim components for siding construction are disclosed. The principal trim component is a trim strip having a J-shaped channel and a smaller adjacent C-shaped channel opening substantially perpendicular to each other. Two of these trim strips together with a corner cap form an outside corner assembly. The unique trim strip also has unique uses for covering soffits and window and door trim.

13 Claims, 4 Drawing Figures

CHANNEL MEMBER FOR SIDING CONSTRUCTION

BACKGROUND-SUMMARY OF THE INVENTION

Various types of trim components are commonly used in siding construction today. Whether the siding is aluminum, plastic (typically polyvinyl chloride or "vinyl"), plastic coated metal, or steel, trim and accessory components are necessary to install the siding on the building and finish it off. These trim components typically comprise inside corners, outside corners, J-channels, drip caps, starter strips, utility trim, fascia caps, L-channels, sill covers and various other trim molding.

When outside corners are installed, the cap members are first nailed to the building and the siding panels are subsequently installed. Thus, if a cap member is damaged, both surfaces of panels adjacent the corner must be removed and the damaged cap member pried from the structure. Also, when building soffits are covered with siding adjacent a wall which is also being covered, two separate trim components are required, such as a standard J-channel for the soffit panels and a utility trim for the wall panels. Each of these trim components must be cut, positioned and nailed separately to the structure. Further, when the moldings around windows and doors are being covered with siding, the preformed or formed-on-site trim components are commonly nailed to the adjacent wall surface. This method requires that all window and door trim work be completed prior to the start of the wall siding, and also requires the removal of a large portion of the wall siding in order to replace any damaged pieces of trim. The substantial work required in replacing either of the two damaged items mentioned above also means that a normal homeowner would probably not be able to make the repairs, but would have to go to the trouble and expense of hiring an outside contractor.

The present invention overcomes the above-mentioned problems and provides a unique trim component with a variety of uses and advantages. The trim strip has two adjacent channels which are aligned to open substantially perpendicular to each other. A larger J-type channel is provided in the strip to receive the siding panels, and an adjacent smaller C-shaped channel is provided to receive and securely hold an edge of a corner cap, siding panel, window trim component, or the like. The invention allows quick and inexpensive replacement of damaged corner caps and window trim, eliminates the use of multiple trim strips on soffits thus saving considerable time, labor, material and expense, and also provides a unique assembly for outside corners.

Other objects, features and advantages of the invention will become apparent from the following detailed description of the invention, when viewed in connection with the accompanying drawings.

DESCRIPTION OF THE PREFERRED EMBODIMENTS

Figure 1:
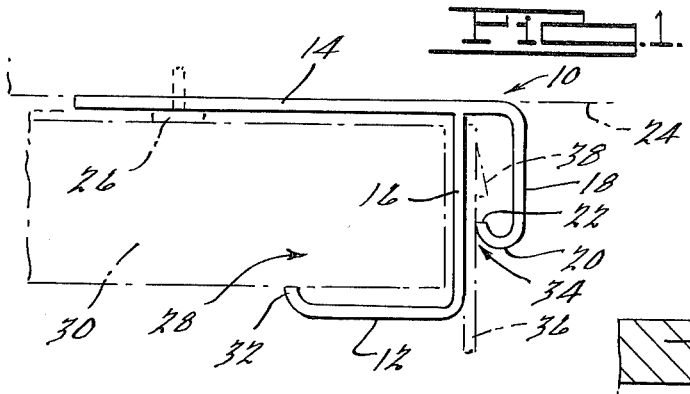
FIG. 1 is a cross-sectional view of the present invention.

FIG. 1 illustrates a cross-sectional view of the inventive trim strip component. The trim strip 10 can be used with any of the various types of siding construction in use today, and can be made of aluminum, polyvinyl chloride (vinyl), steel, plastic covered metal, or any other similar or compatible material. As will be understood by persons skilled in the siding construction field, the trim component will be manufactured in elongated, thin strips and cut to an appropriate length for use at the building site. In this regard, the trim strip 10 can be molded, extruded or roll-formed from a flat sheet. Preferably, the trim strip 10 is made of vinyl and profile extruded in the cross-sectional shape shown in FIG. 1.

The trim component 10 has a front panel 12, and a rear panel 14 connected by a transverse panel 16. The front and rear panels 12 and 14 are substantially parallel to each other, while the transverse panel 16 is substantially perpendicular to each of panels 12 and 14. The rear panel 14 extends beyond the intersection with the transverse panel 16 and is connected to a second transverse panel 18 which is substantially parallel to panel 16. The outer end of panel 18 in turn is connected to a rounded hooktype flange 20 which has its end 22 curved inwardly back toward rear panel 14.

In use, the trim strip 10 is fastened (nailed) to a surface of a building, residence or other structure 24. To this end, the rear panel 14 extends outwardly beyond the end of front panel 12 and provides an elongated nailing area for the nails 26.

The panels 12, 14, and 16 form a J-shaped channel 28 which is adapted to receive the edges of a row of siding panels 30 (shown in phantom lines in FIG. 1). As shown, the channel 28 opens outwardly in a direction along the surface of the building 24. A flange 32 is attached to the outer end of front panel 12 and turned in toward the rear panel 14 to insure that the edges of the siding panels 20 are retained in the channel 28. The width of the channel 28 is predetermined relative to the size and shape of the siding panels 30.

The panel 18 and flange 20, in combination with flange 16, form a second channel 34 which is essentially "C-shaped" and smaller than channel 28. The channel 34 also opens in a direction substantially perpendicular to channel 28. The width of the channel 34 is predetermined to receive and firmly hold in place a single thickness of one of the siding components used to cover the building 24. An edge of a siding or trim component is shown in phantom lines in FIG. 1 and indicated by the numeral 36. The channel 34 is designed to have a width slightly less than the thickness of the siding component 36 so that the component 36 will be held tightly in place by friction and tension. The inherent characteristics of most siding materials, such as vinyl, aluminum and steel, are such that the panel 18 will flex or bend outwardly when the component 36 is inserted in place in the channel 34 and then press the component 36 firmly against panel 16 holding it in place. If desired, a locking tang or similar projection 38 can be formed on the edge of the component 36 to assist in permanently holding together in mating relationship the two siding components 10 and 36. The locking tab 38 can be formed with a conventional tool commonly known as a "snap lock punch".

Figure 2:
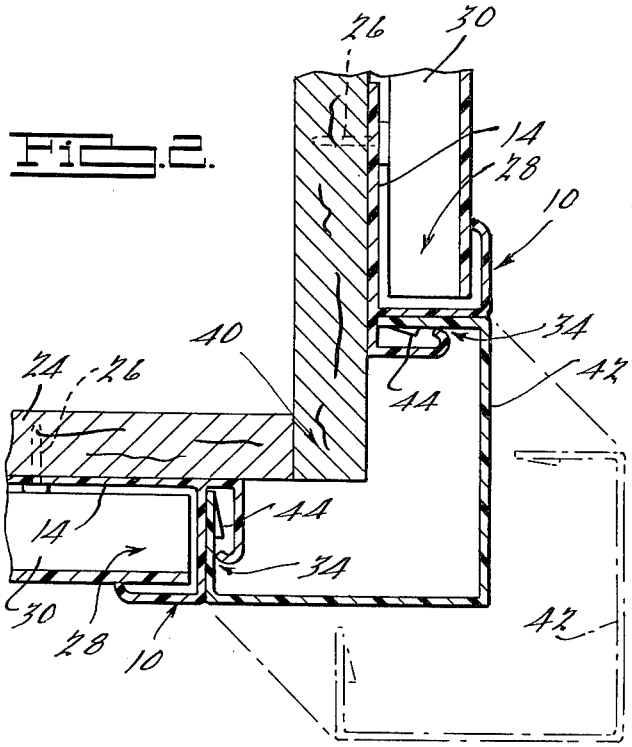
FIG. 2 illustrates the use of the present invention to form a unique outside corner trim assembly.

One of the various uses of the inventive trim component 10 is shown in FIG. 2. In this embodiment, a pair of trim strips 10 are attached to an outside corner 40 of a building 24 and comprise part of a unique and inventive outside corner trim assembly. The trim strips 10 are nailed to the building 24 near the corner 40 along adjacent perpendicular surfaces. After the strips 10 are in place, the siding panels 30, which can be either horizontal or vertical panels, are slid or dropped in the channels 28 and the building surfaces are covered with siding.

A cap member 42, is positioned in each of the C-shaped channels 34 in the trim strips 10. The cap 42 is mated with the two trim strips 10 at the factory before the composite unit is shipped to the site in order to enhance the final positioning of the strips 10 on the building. The cap 42 is essentially shaped like a hollow square in cross-section with one corner removed and is preferably made of the same material as the trim strips 10 and siding panels 30. When the trim strips 10 are to be used as part of a corner assembly, the width of the channels 34 is designed relative to the thickness of the walls of the cap 42 so that a secure mating relationship is established. Preferably, a plurality of locking tangs or projections 44 are formed along the ends of the cap 42 to aid in holding the cap in place.

In known outside corner assemblies, particularly in the vinyl siding field, a cap member is provided which has two nailing flanges on it. Such cap is permanently fastened to the building before the siding panels are installed. Thus, in the event the cap member becomes damaged or needs replacement, which is not uncommon, it is impossible to remove the cap without removing both adjacent surfaces of siding panels. Since each row of siding panels is also nailed to the structure, the time, effort and expense involved in replacing the cap is substantial. In contrast, with the present invention, the cap 42 can be removed and replaced quickly and easily—and by the homeowner himself. Also, to prevent the outside corner cap members from becoming damaged during the remainder of the siding construction (which also is not uncommon), the cap 42 can be removed by the installer after the trim strips 10 are nailed in place and kept in a safe place until the entire job is completed.

Figure 3:
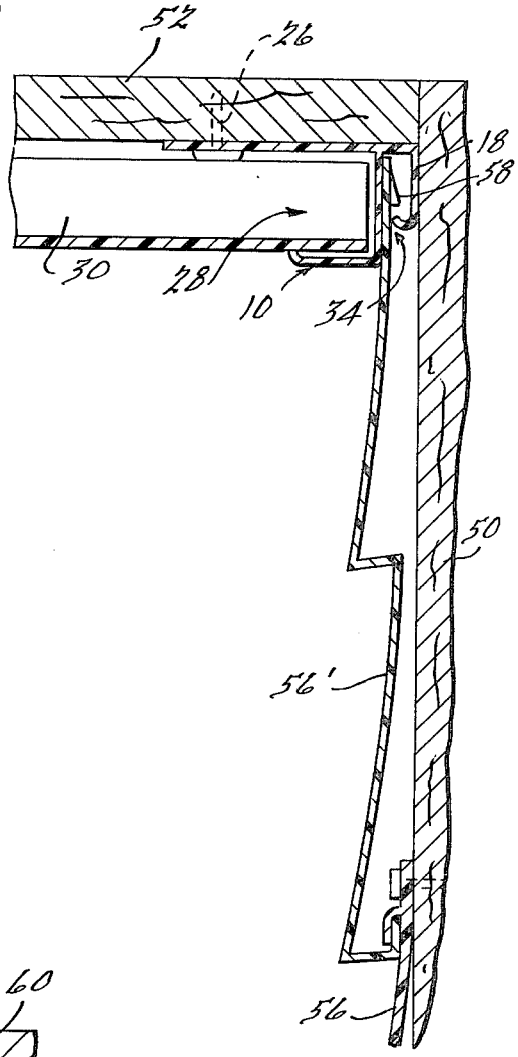
FIG. 3 illustrates the use of the present invention as part of a building soffit system.

FIG. 3 illustrates the use of the inventive trim strip 10 in a soffit system for a building. In this view, a vertical side wall 50 and a soffit 52 are illustrated. The trim strip 10 is nailed in place in the corner where the side wall 50 meets the soffit 52. The J-shaped channel 28 is positioned along the soffit and the transverse panel 18 is abutted against the wall 50. A plurality of siding panels 30 are slid in place along the soffit and supported at one end by the channel 28. The opposite ends of the siding panels 30 can be secured to and supported by the soffit or fascia by any of the conventional techniques that are well known in the siding industry (not shown).

The C-channel 34 on the strip 10 retains the upper edge of the top row of the wall siding 56'. As the wall of siding panels 56 proceeds during installation from the bottom of the wall 50 to the soffit 52, the upper most row 56' is cut to size by the installer and the upper edge is snap lock punched with tangs 58 and inserted in place in channel 54. The strip 10 thus provides a simple, quick, neat and attractive manner in which to completely cover a building wall and soffit combination.

Figure 4:
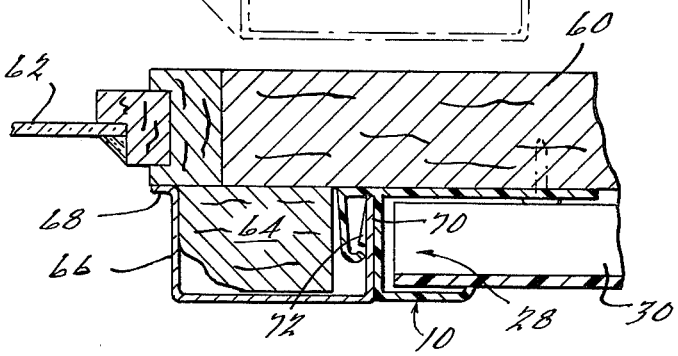
FIG. 4 illustrates the use of the present invention as part of a window or door trim assembly.

The trim strip 10 also has a unique and beneficial use relative to siding construction around windows and doors. (For ease of explanation, the invention will be described relative to use with window trim, but it is to be understood that the invention is equally applicable for use with door trim, or for trimming any other wall opening.) As shown in FIG. 4, a wall 60 of a building has a window 62 in it. The strip 10 is nailed to the wall 60 adjacent to the outside window molding 64. The siding panels 30, which can be either horizontal or vertical panels, are positioned in place in the J-shaped channel 28. When the molding 64 of the window 62 is covered with the siding material, a premolded or folded-on-site trim component 66, normally made from aluminum, is used to cover the molding 64. One end 68 of the trim 66 is bent outwardly to cover the edge of the window casing and the other end 70 is held fixedly in place in the C-shaped channel 34 of the trim strip 10. Preferably, a locking tang 72 is punched in the end 70 to help hold the trim component 66 in place.

When known window trim cover components are utilized today, the outer end (corresponding to end 70 of trim component 66) is nailed directly to the wall. Thereafter the wall surface trim and then the wall siding panels are installed. In contrast, the present invention permits the use of less complex window trim components, eliminates the step of nailing of the window trim components to the building wall surface, and further allows the option of installing the wall siding panels either before or after the window trim is installed.

While it is apparent that the preferred embodiments illustrated herein are well calculated to fulfill the objects above stated, it will be appreciated that the present invention is susceptible to modification, variation and change without departing from the scope of the invention, as defined by the following claims.

I claim:

1. An elongated trim strip for siding construction on a structure, said trim strip having a first channel adapted to retain a relatively thick edge portion of one siding element and a second channel adapted to retain a relatively thin edge portion of another siding element, said trim strip comprising:

a rear panel adapted to be secured to said structure;

a first transverse panel integral with said rear panel and extending outwardly therefrom;

a front panel integral with said first transverse panel and extending generally parallel to said rear panel, said front panel cooperating with said first transverse panel and the portion of said rear panel adjacent to said first transverse panel to form said first channel;

a second transverse panel integral with said rear panel and extending outwardly therefrom, said second transverse panel being positioned on the same side of said rear panel as said first transverse panel, said second transverse panel extending generally parallel to, but a shorter distance than, said first transverse panel and being positioned on the other side of said first transverse panel from said front panel, said second transverse panel cooperating with said first transverse panel and the portion of said rear panel extending between said first transverse panel and said second transverse panel to form said second channel;

means for retaining a relatively thick edge portion of one siding element associated with said first channel; and means for retaining a relatively thin edge portion of another siding element associated with said second channel.

2. The invention as set forth in claim 1 wherein said first transverse panel is substantially perpendicular to each of said rear panel and said front panel.

3. The invention as set forth in claim 1 wherein said rear panel extends beyond said front panel, providing a nailing strip for securing said trim strip to said structure.

4. The invention as set forth in claim 1 wherein said means for retaining a relatively thick edge portion of said one siding element associated with said first channel comprises an integral flange on the outer end of said front panel, said flange extending inwardly toward said rear panel.

5. The invention as set forth in claim 1 wherein said means for retaining a relatively thin edge portion of said another siding element associated with said second channel comprises a reversely bent end portion on said second transverse panel.

6. The invention as set forth in claim 1 wherein said front panel and said second transverse panel are made of a flexible material.

7. The invention as set forth in claim 1 including, in combination therewith, a second elongated trim strip as recited in claim 1 and a cap member, said cap member having an elongated construction with two lateral edge portions, one of said edge portions being retained in said second channel of said elongated trim strip, the other of said edge portions being retained in said second channel of said second elongated trim strip.

8. The invention as set forth in claim 1 including, in combination therewith, a trim component for a wall opening, said trim component having an edge portion retained in said second channel.

9. The invention as set forth in claim 1 including, in combination therewith, a first siding panel having a relatively thick edge portion retained in said first channel and a second siding panel having a relatively thin edge portion retained in said second channel.

10. An elongated trim strip for siding construction on a structure, said trim strip having a first channel adapted to retain a relatively thick edge portion of one siding element and a second channel adapted to retain a relatively thin edge portion of another siding element, said trim strip comprising:

a rear panel adapted to be secured to said structure;

a first transverse panel integral with said rear panel and extending outwardly at about a right angle therefrom;

a front panel integral with said first transverse panel and extending generally parallel to said rear panel, said front panel cooperating with said first transverse panel and the portion of said rear panel adjacent to said first transverse panel to form said first channel and said rear panel extending beyond said front panel to provide a nailing strip for securing said trim strip to said structure;

a second transverse panel integral with said rear panel and extending outwardly therefrom, said second transverse panel being positioned on the same side of said rear panel as said first transverse panel, said second transverse panel extending generally parallel to, but a shorter distance than, said first transverse panel and being positioned on the other side of said first transverse panel from said front panel, said second transverse panel cooperating with said first transverse panel and the portion of said rear panel extending between said first transverse panel and said second transverse panel to form said second channel;

an integral flange on the outer end of said front panel, said flange extending inwardly toward said rear panel and being adapted to clampingly engage said relatively thick edge portion of one siding element; and a reversely bent end portion on said second transverse panel, said reversely bent end portion extending in said second channel and being adapted to clampingly engage said relatively thin edge portion of another siding panel.

11. The invention as set forth in claim 10 including, in combination therewith, a second elongated trim strip as recited in claim 1 and a cap member, said cap member having an elongated construction with two lateral edge portions, one of said edge portions being retained in said second channel of said elongated trim strip, the other of said edge portions being retained in said second channel of said second elongated trim strip.

12. The invention as set forth in claim 10 including, in combination therewith, a trim component for a wall opening, said trim component having an edge portion retained in said second channel.

13. The invention as set forth in claim 10 including, in combination therewith, a first siding panel having a relatively thick edge portion retained in said first channel and a second siding panel having a relatively thin edge portion retained in said second channel.

* * * * *